US007206418B2

(12) United States Patent
Yang et al.

(10) Patent No.: US 7,206,418 B2
(45) Date of Patent: Apr. 17, 2007

(54) NOISE SUPPRESSION FOR A WIRELESS COMMUNICATION DEVICE

(75) Inventors: Feng Yang, Plano, TX (US); Yen-Son Paul Huang, Saratoga, CA (US)

(73) Assignee: ForteMedia, Inc., Cupertino, CA (US)

( * ) Notice: Subject to any disclaimer, the term of this patent is extended or adjusted under 35 U.S.C. 154(b) by 483 days.

(21) Appl. No.: 10/076,201

(22) Filed: Feb. 12, 2002

(65) Prior Publication Data

US 2002/0193130 A1 Dec. 19, 2002

Related U.S. Application Data

(60) Provisional application No. 60/268,403, filed on Feb. 12, 2001.

(51) Int. Cl.
*H04R 3/00* (2006.01)

(52) U.S. Cl. ..... 381/92; 381/94.7

(58) Field of Classification Search ..... 381/92, 381/94.1, 94.2, 94.3, 71.1, 94.7; 704/226, 704/233

See application file for complete search history.

(56) References Cited

U.S. PATENT DOCUMENTS 5,353,376 A * 10/1994 Oh et al. ..... 704/233
5,473,684 A * 12/1995 Bartlett et al. ..... 379/395
5,602,962 A * 2/1997 Kellermann ..... 704/226
5,610,991 A * 3/1997 Janse ..... 381/92
5,740,256 A * 4/1998 Castello Da Costa et al. ..... 381/94.7
5,754,665 A * 5/1998 Hosoi ..... 381/94.1
6,430,295 B1 * 8/2002 Handel et al. ..... 381/94.7
6,453,285 B1 * 9/2002 Anderson et al. ..... 381/94.3
6,594,367 B1 * 7/2003 Marash et al. ..... 381/92
2002/0009203 A1 * 1/2002 Erten ..... 381/92
2002/0138254 A1 * 9/2002 Isaka et al. ..... 704/208
2003/0233213 A1 * 12/2003 Balan et al. ..... 702/180
2004/0092297 A1 * 5/2004 Huang ..... 455/575.7

OTHER PUBLICATIONS

Saruwatari, Hiroshi; Kajita, Shoji; Takeda, Kazuya; Itakura, Fumitada; "Speech Enhancement Using Nonlinear Microphone Array", Mar. 1999, IEEE International Conference on Acoustics, Speech, and Signal Processing, 1999. pp. 69-72 vol. 1.*

* cited by examiner

*Primary Examiner*—Brian T. Pendleton
(74) *Attorney, Agent, or Firm*—Dinh & Associates

(57) ABSTRACT

Techniques to suppress noise from a signal comprised of speech plus noise. In accordance with aspects of the invention, two or more signal detectors (e.g., microphones) are used to detect respective signals having speech and noise components, with the magnitude of each component being dependent on various factors such as the distance between the speech source and the microphone. Signal processing is then used to process the detected signals to generate the desired output signal having predominantly speech with a large portion of the noise removed. The techniques described herein may be advantageously used for both near-field and far-field applications, and may be implemented in various mobile communication devices such as cellular phones.

30 Claims, 7 Drawing Sheets

NOISE SUPPRESSION FOR A WIRELESS COMMUNICATION DEVICE

BACKGROUND

The present invention relates generally to communication apparatus. More particularly, it relates to techniques for suppressing noise in a speech signal, and which may be used in a wireless or mobile communication device such as a cellular phone.

In many applications, a speech signal is received in the presence of noise, processed, and transmitted to a far-end party. One example of such a noisy environment is wireless application. For many conventional cellular phones, a microphone is placed near a speaking user's mouth and used to pick up speech signal. The microphone typically also picks up background noise, which degrades the quality of the speech signal transmitted to the far-end party.

Newer-generation wireless communication devices are designed with additional capabilities. Besides supporting voice communication, a user may be able to view text or browse World Wide Web page via a display on the wireless device. New videophone service requires the user to place the phone away, which therefore requires "far-field" speech pick-up. Moreover, "hands-free" communication is safer and provides more convenience, especially in an automobile. In any case, the microphone in the wireless device may be used in a "far-field" mode whereby it may be placed relatively far away from the speaking user (instead of being pressed against the user's ear and mouth). For far-field communication, less signal and more noise are received by the microphone, and a lower signal-to-noise ratio (SNR) is achieved, which typically leads to poor signal quality.

One common technique for suppressing noise is the spectral subtraction technique. In a typical implementation of this technique, speech plus noise is received via a single microphone and transformed into a number of frequency bins via a fast Fourier transform (FFT). Under the assumption that the background noise is long-time stationary (in comparison with the speech), a model of the background noise is estimated during time periods of non-speech activity whereby the measured spectral energy of the received signal is attributed to noise. The background noise estimate for each frequency bin is utilized to estimate an SNR of the speech in the bin. Then, each frequency bin is attenuated according to its noise energy content with a respective gain factor computed based on that bin's SNR.

The spectral subtraction technique is generally effective at suppressing stationary noise components. However, due to the time-variant nature of the noisy environment (e.g., street, airport, restaurant, and so on), the models estimated in the conventional manner using a single microphone are likely to differ from actuality. This may result in an output speech signal having a combination of low audible quality, insufficient reduction of the noise, and/or injected artifacts.

Another technique for suppressing noise is with a microphone array. For this technique, multiple microphones are arranged typically in a linear or some other type of array. An adaptive or non-adaptive method is then used to process the signals received from the microphones to suppress noise and improve speech SNR. However, the microphone array has not been applied to mobile communication devices since it generally require certain size and cannot be fit into the small form factor of current mobile devices.

Conventional wireless communication devices such as cellular phones typically utilize a single microphone to pick up speech signal. The single microphone design limits the type of signal processing that may be performed on the received signal, and may further limit the amount of improvement (i.e., the amount of noise suppression) that may be achievable. The single microphone design is also ineffective at suppressing noise in far-field application where the microphone is placed at a distance (e.g., a few feet) away from the speech source.

As can be seen, techniques that can be used to suppress noise in a speech signal in a wireless environment are highly desirable.

SUMMARY

The invention provides techniques to suppress noise from a signal comprised of speech plus noise. In accordance with aspects of the invention, two or more signal detectors (e.g., microphones) are used to detect respective signals. Each detected signal comprises a desired speech component and an undesired noise component, with the magnitude of each component being dependent on various factors such as the distance between the speech source and the microphone, the directivity of the microphone, the noise sources, and so on. Signal processing is then used to process the detected signals to generate the desired output signal having predominantly speech, with a large portion of the noise removed. The techniques described herein may be advantageously used for both near-field and far-field applications, and may be implemented in various wireless and mobile devices such as cellular phones.

An embodiment of the invention provides a mobile communication device that includes a number of signal detectors (e.g., two microphones), optional first and second beam forming units, and a noise suppression unit. The beam forming units and noise suppression unit may be implemented within a digital signal processor (DSP). Each signal detector provides a respective detected signal having a desired component plus an undesired component. The first beam forming unit receives and processes the detected signals to provide a first signal s(t) having the desired component plus a portion of the undesired component. The second beam forming unit receives and processes the detected signals to provide a second signal x(t) having a large portion of the undesired component. The noise suppression unit then receives and digitally processes the first and second signals to provide an output signal y(t) having substantially the desired component and a large portion of the undesired component removed. The noise suppression unit may be designed to digitally process the first and second signals in the frequency domain, although signal processing in the time domain is also possible. The noise suppression unit may be designed to perform the noise cancellation using spectrum modification technique, which provides improved performance over other noise cancellation techniques.

In one specific design, the noise suppression unit includes a noise spectrum estimator, a gain calculation unit, a speech or voice activity detector, and a multiplier. The noise spectrum estimator derives an estimate of the spectrum of the noise based on a transformed representation of the second signal. The gain calculation unit provides a set of gain coefficients for the multiplier based on a transformed representation of the first signal and the noise spectrum estimate. The multiplier receives and scales the magnitude of the transformed first signal with the set of gain coefficients to provide a scaled transformed signal, which is then inverse transformed to provide the output signal. The activity detector provides a control signal indicative of active and non-active time periods, with the active time periods indicating that the first signal includes predominantly the desired component. The first beam forming unit may be allowed to adapt during the active time periods, and the second beam forming unit may be allowed to adapt during the non-active time periods.

Another aspect of the invention provides a wireless communication device, e.g., a mobile phone, having at least two microphones and a signal processor. Each microphone detects and provides a respective detected signal comprised of a desired component and an undesired component. For each detected signal, the specific amount of each (desired and undesired) component included in the detected signal may be dependent on various factors, such as the distance to the speaking source and the directivity of the microphone. The signal processor receives and digitally processes the detected signals to provide an output signal having substantially the desired component and a large portion of the undesired component removed. The signal processing may be performed in a manner that is dependent in part on the characteristics of the detected signals.

Various other aspects, embodiments, and features of the invention are also provided, as described in further detail below.

The foregoing, together with other aspects of this invention, will become more apparent when referring to the following specification, claims, and accompanying drawings.

DESCRIPTION OF THE SPECIFIC EMBODIMENTS

Figure 1A:
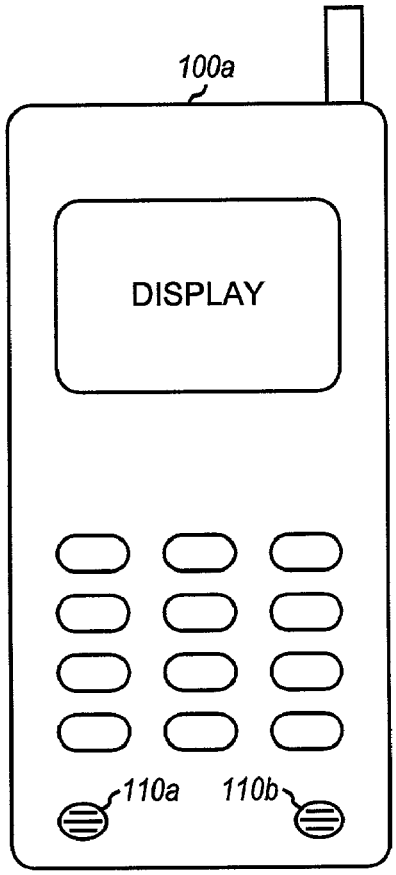
FIGS. 1A through 1C are diagrams of three wireless communication devices capable of implementing various aspects of the invention.

FIG. 1A is a diagram of an embodiment of a wireless communication device 100*a* capable of implementing various aspects of the invention. In this embodiment, device 100*a* is a cellular phone having a pair of microphones 110*a* and 110*b*. Microphone 110*a* is located in the lower left corner of the device, and microphone 110*b* is located in the lower right corner of the device. The microphones may also be located in other parts of the device, and this is within the scope of the invention. The placement of the microphones may be constrained by various factors such as the small size of the cellular phone, manufacturability, and so on.

Figure 1B:
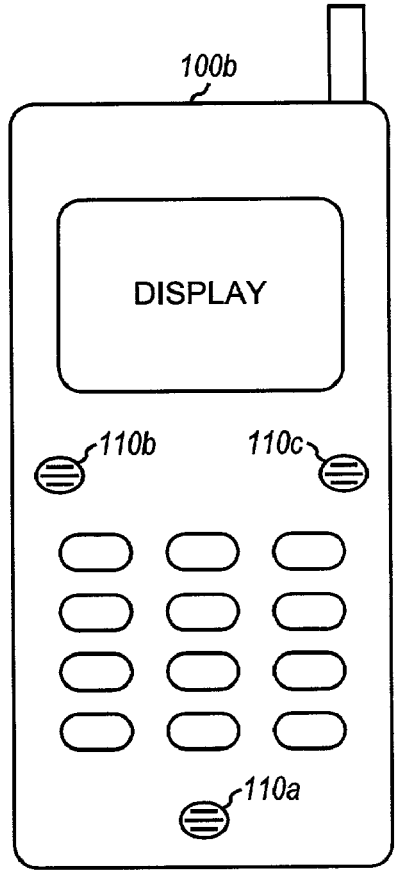

FIG. 1B is a diagram of an embodiment of a wireless communication device 100*b* having three microphones 110. In this embodiment, microphone 110*a* is located in the lower center of the device near a speaking user's mouth and may be used to pick up desired speech plus undesired background noise. Microphone 110*b* is located in the middle left side of the device, and microphone 110*c* is located in the middle right side of the device. Additional microphones may also be used, and the microphones may also be placed in other parts of the device, and this is within the scope of the invention. The microphones do not need to be placed in an array. For improved performance, the microphones may be located as far away from each other as practically possible.

Figure 1C:
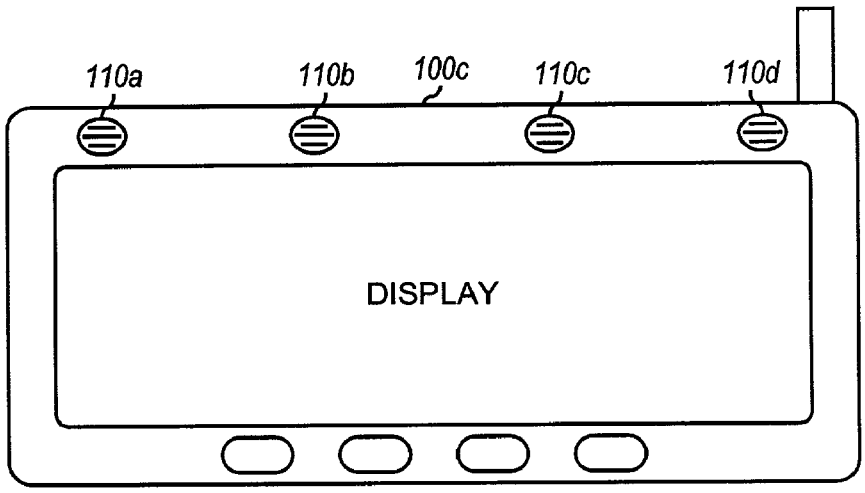

FIG. 1C is a diagram of an embodiment of a wireless communication device 100*c* having a number of microphones 110. In this embodiment, device 100*c* includes a larger sized display, which may be used for displaying text, graphics, videos, and so on. Device 100*c* may be a handset for the new $3^{rd}$ generation (3GPP) wireless communication systems under development and deployment. Device 100*c* may also be a personal digital assistant (PDA) with voice recognition or phone function. Device 100*c* may also be a video phone with or without web-browser capability. In general, device 100*c* may be any device capable of supporting voice communication possibly along with other functions (e.g., text, video, and so on). In the specific embodiment shown in FIG. 1C, microphones 110*a* through 110*d* are located in a line above the display area. The microphones may also be placed in other locations of the device.

Each of devices 100*a*, 100*b*, and 100*c* advantageously employ two or more microphones to allow the device to be used for both "near-field" and "far-field" applications. For near-field application, one microphone (e.g., microphone 110*a* in FIG. 1B) or multiple microphones (e.g., microphones 110*a* and 110*b* in FIG. 1A) may be used to pick up speech signal from a close-by source. And for far-field application, the microphones are designed to pick up speech signal from a source located further away. Noise suppression is used to remove noise and improve signal quality.

Devices 100*a* and 100*b* are similar to conventional cellular phones and may be used with the devices placed close to the speaking user. With the noise suppression techniques described herein, devices 100*a* and 100*b* may also be used in a hand-free mode whereby they are located further away from the speaking user. Device 100*c* is a handset that may be designed to be placed away from the user (e.g., one to two feet away) during use, which allows the user to better view the display while talking.

Figure 2:
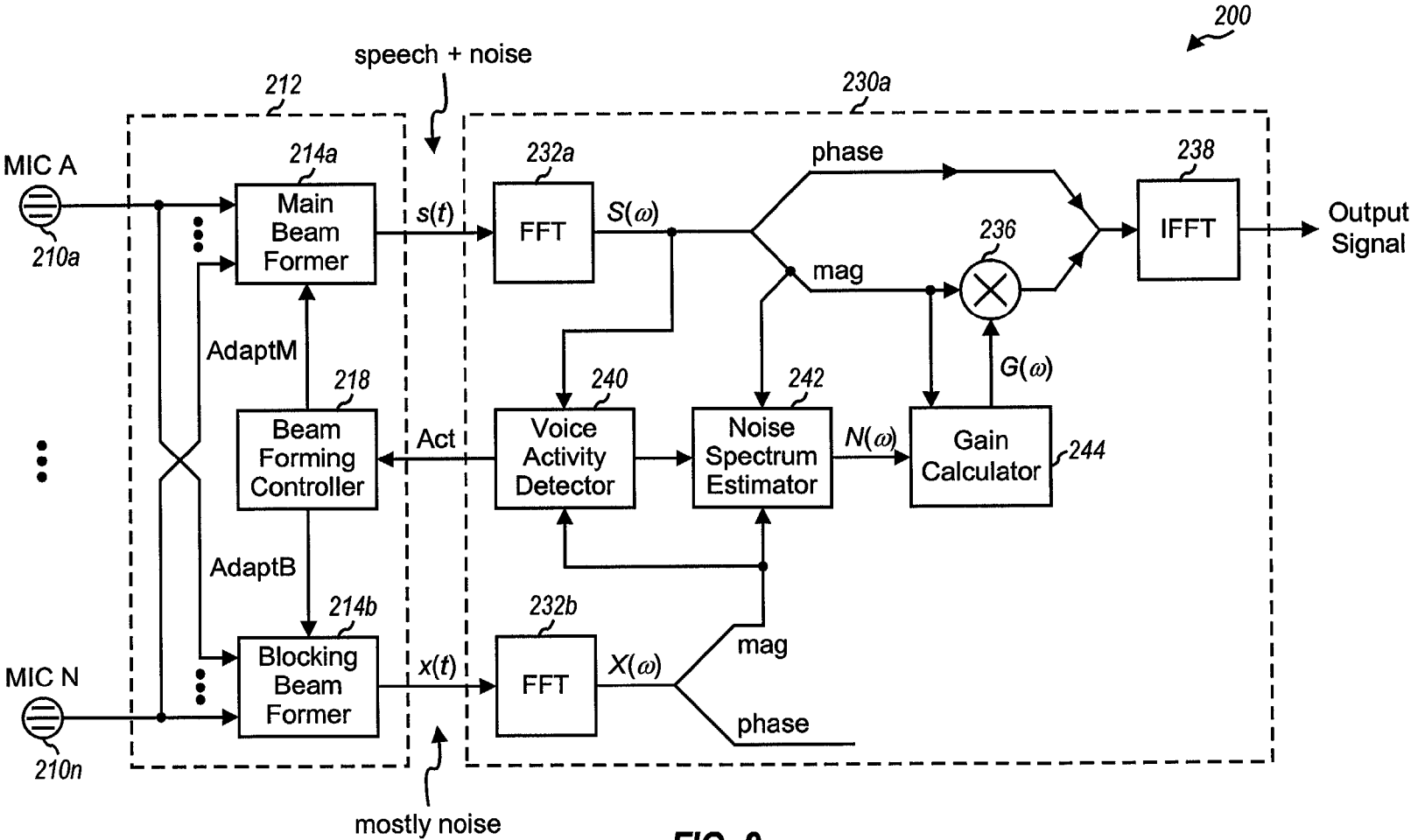
FIG. 2 is a block diagram of a speech processing system suitable for removing background noise from a speech plus noise signal, and may be used for both near-field and far-field applications.

FIG. 2 is a block diagram of a speech processing system 200 capable of removing background noise from a speech plus noise signal and utilizing a number of signal detectors. In an embodiment, microphones are used as the signal detectors. System 200 may be used for both near-field and far-field applications, and may be implemented in each of devices 100*a* through 100*c* in FIGS. 1A through 1C, respectively.

System 200 includes two or more microphones 210*a* through 210*n*, a beam forming unit 212, and a noise suppression unit 230*a*. Beam forming unit 212 may be optional for some devices (e.g., for devices that use directional microphones), as described below. Beam forming unit 212 and a noise suppression unit 230*a* may be implemented within one or more digital signal processors (DSPs) or some other integrated circuit.

Each microphone provides a respective analog signal that is typically conditioned (e.g., filtered and amplified) and then digitized prior to being subjected to the signal processing by beam forming unit 212 and noise suppression unit 230*a*. For simplicity, this conditioning and digitization circuitry is not shown in FIG. 2.

The microphones may be located either close to, or at a relatively far distance away from, the speaking user during use. Each microphone 210 detects a respective signal having a speech component plus a noise component, with the magnitude of the received components being dependent on various factors, such as (1) the distance between the microphone and the speech source, (2) the directivity of the microphone (e.g., whether the microphone is directional or omni-directional), and so on. The detected signals from microphones 210*a* through 210*n* are provided to each of two beam forming units 214*a* and 214*b* within unit 212.

Figure 3A:
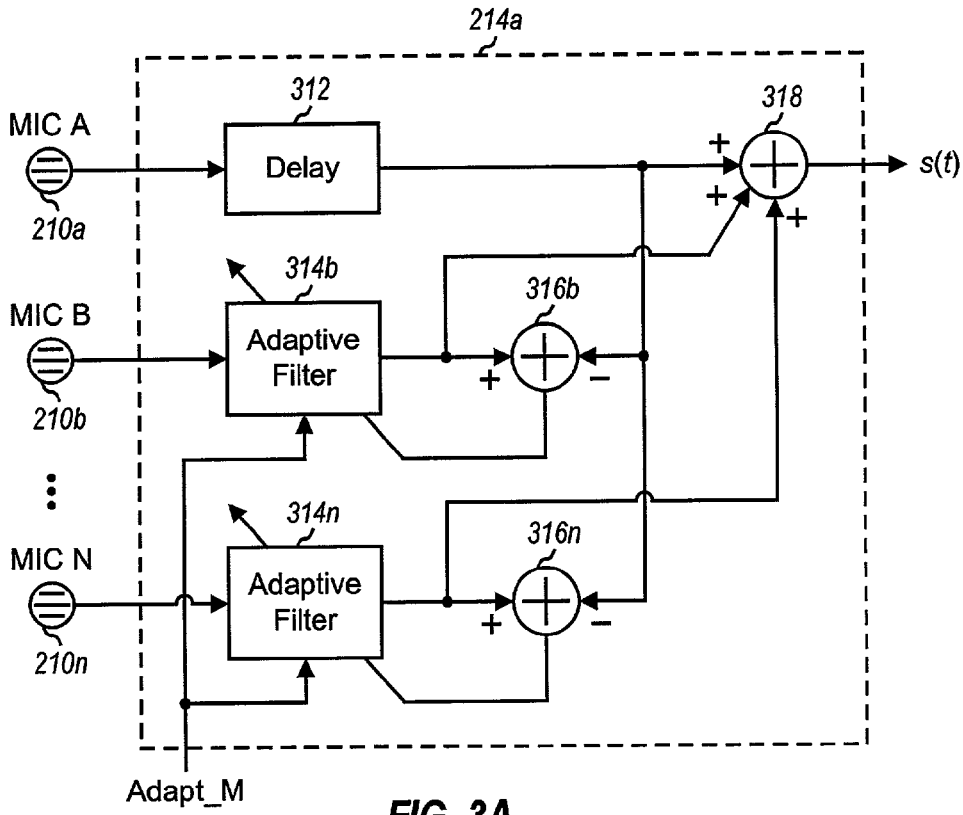
FIGS. 3A and 3B are block diagrams of an embodiment of a main beam forming unit and a blocking beam forming unit, respectively.

Main beam forming unit 214*a*, which is also referred to as the "main beam former", processes the signals from microphones 210*a* through 210*n* to provide a signal s(t) comprised of speech plus noise. Main beam forming unit 214*a* may further be able to suppress a portion of the received noise component. Main beam forming unit 214*a* may be designed to implement any type of beam former that attempts to reject as much interference and noise as possible. A specific design for main beam forming unit 214*a* is shown in FIG. 3A below. Main beam forming unit 214*a* may also be an optional unit that may be omitted for some devices (e.g., if the signal s(t) can be obtained from one microphone). Main beam forming unit 214*a* provides the signal s(t) to noise suppression unit 230*a*.

Figure 3B:
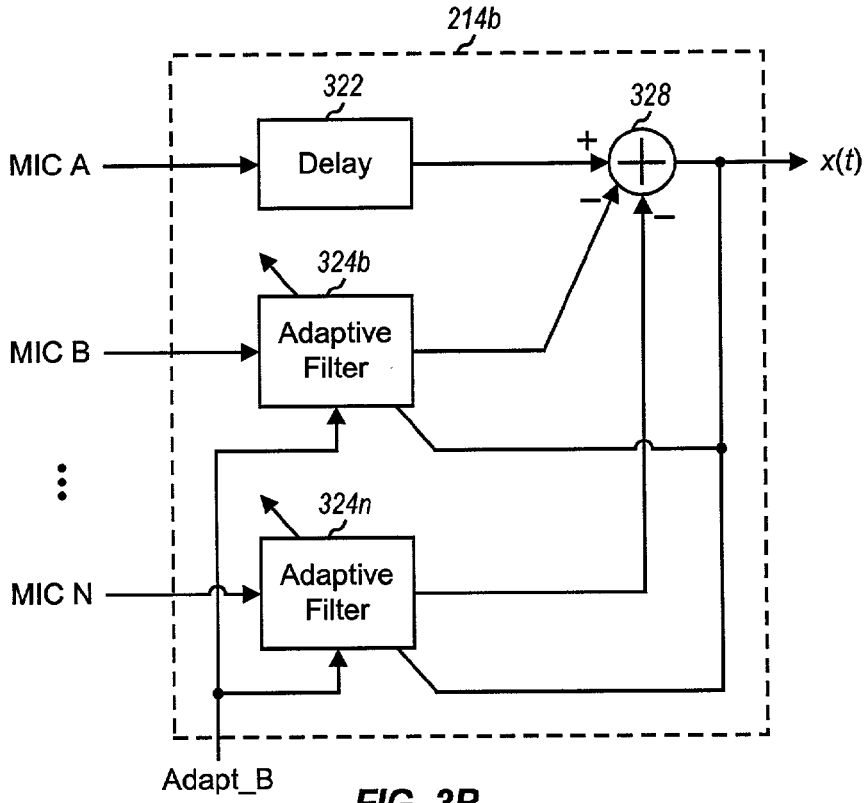

Blocking beam forming unit 214*b*, which is also referred to as a "blocking beam former", processes the signals from microphones 210*a* through 210*n* to provide a signal x(t) comprised of mostly the noise component. Blocking beam forming unit 214*b* is used to provide an accurate estimate of the noise, and to block as much of the desired speech signal as possible. This then allows for effective cancellation of the noise in the signal s(t). Blocking beam forming unit 214*b* may also be designed to implement any one of a number of beam formers, one of which is shown in FIG. 3B below. Blocking beam forming unit 214*b* provides the signal x(t) to noise suppression unit 230*a*. By employing blocking beam forming unit 214*b* to generate the mostly noise signal x(t), system 200 may utilize various types of microphone (e.g., omni-directional microphone, dipole microphones, and so on) which may pick up any combination of signal and noise.

A beam forming controller 218 directs the operation of main and blocking beam forming units 214*a* and 214*b*. Controller 218 typically receives a control signal from a voice activity detector (VAD) 240. Voice activity detector 240 detects the presence of speech at the microphones and provides the Act control signal indicating periods of speech activity. The detection of speech activity can be performed in various manners known in the art, one of which is described by D. K. Freeman et al. in a paper entitled "The Voice Activity Detector for the Pan-European Digital Cellular Mobile Telephone Service," 1989 IEEE International Conference Acoustics, Speech and Signal Processing, Glasgow, Scotland, Mar. 23–26, 1989, pages 369–372, which is incorporated herein by reference.

Beam forming controller 218 provides the necessary controls that direct main and blocking beam forming units 214*a* and 214*b* to adapt at the appropriate times. In particular, controller 218 provides an Adapt_M control signal to main beam forming unit 214*a* to enable it to adapt during periods of speech activity and an Adapt_B control signal to blocking beam forming unit 214*b* to enable it to adapt during periods of non-speech activity. In one simple implementation, the Adapt_B control signal is generated by inverting the Adapt_M control signal.

FIG. 3A is a block diagram of an embodiment of main beam forming unit 214*a*. The signal from microphone 210*a* is provided to a delay element 312 and the signals from microphones 210*b* through 210*n* are respectively provided to adaptive filters 314*b* through 314*n*. Delay element 312 provides delay for the signal from microphone 210*a* such that the delayed signal is approximately time-aligned with the outputs from adaptive filters 314*b* through 314*n*. The amount of delay to be provided by delay element 312 is thus dependent on the design of adaptive filters 314. One particular delay length may be a half of the tap number of the adaptive filters, if a finite impulse response (FIR) adaptive filter is used for each adaptive filter.

Each adaptive filter 314 filters the received signal such that the error signal e(t) used to update the adaptive filter is minimized during the adaptation period. Adaptive filters 314 may be designed to implement any one of a number of adaptation algorithms known in the art. Some such algorithms include a least mean square (LMS) algorithm, a normalized mean square (NLMS), a recursive least square (RLS) algorithm, and a direct matrix inversion (DMI) algorithm. Each of the LMS, NLMS, RLS, and DMI algorithms (directly or indirectly) attempts to minimize the mean square error (MSE) of the error signal e(t) used to update the adaptive filter. In an embodiment, the adaptation algorithm implemented by adaptive filters 314*b* through 314*n* is the NLMS algorithm.

The NLMS algorithm is described in detail by B. Widrow and S. D. Stems in a book entitled "Adaptive Signal Processing," Prentice-Hall Inc., Englewood Cliffs, N.J., 1986. The LMS, NLMS, RLS, DMI, and other adaptation algorithms are also described in detail by Simon Haykin in a book entitled "Adaptive Filter Theory", 3rd edition, Prentice Hall, 1996. The pertinent sections of these books are incorporated herein by reference.

As shown in FIG. 3A, the filtered signal from each adaptive filter 314 is subtracted by the delayed signal from delay element 312 by a respective summer 316 to provide the error signal e(t) for that adaptive filter. This error signal is then provided back to the adaptive filter and used to update the response of that adaptive filter. As also shown in FIG. 3A, adaptive filters 314*b* through 314*n* are updated when the Adapt_M control signal is enabled, and are maintained when the Adapt_M control signal is disabled.

To generate the signal s(t), a summer 318 receives and combines the delayed signal from microphone 210*a* with the filtered signals from adaptive filters 314*b* through 314*n*. The resultant output may further be divided by a factor of $N_{mic}$ (where $N_{mic}$ denotes the number of microphones) to provide the signal s(t).

FIG. 3A shows a specific design for main beam forming unit 214*a*. Other designs may also be used and are within the scope of the invention. For example, main beam forming unit 214*a* may be implemented with a "Griffiths-Jim" beam former that is described by L. J. Griffiths and C. W. Jim in a paper entitled "An Alternative Approach to Robust Adaptive Beam Forming," IEEE Trans. Antenna Propagation, January 1982, vol. AP-30, no. 1, pp. 27–34, which is incorporated herein by reference.

FIG. 3B is a block diagram of an embodiment of blocking beam forming unit 214*b*. The signal from microphone 210*a* is provided to a delay element 322 and the signals from microphones 210*b* through 210*n* are respectively provided to adaptive filters 324*b* through 324*n*. Delay element 322 provides an amount of delay approximately matching the delay of adaptive filters 324. One particular delay length may be a half of the tap number of the adaptive filter, if a FIR filter is used for each adaptive filter.

Each adaptive filter 324 filters the received signal such that an error signal e(t) is minimized during the adaptation period. Adaptive filters 324 also may be implemented using various designs, such as with NLMS adaptive filters. To generate the signal x(t), a summer 328 receives and subtracts the filtered signals from adaptive filters 324*b* through 324*n* from the delay signal from delay element 322. The signal x(t) represents the common error signal for all adaptive filters 324*b* through 324*n* within the blocking beam former, and is used to adjust the response of these adaptive filters.

Referring back to FIG. 2, noise suppressor 230*a* performs noise suppression in the frequency domain. Frequency domain processing may provide improved noise suppression and may be preferred over time domain processing because of superior performance. The mostly noise signal x(t) does not need to be highly correlated to the noise component in the speech plus noise signal s(t), and only need to be correlated in the power spectrum, which is a much more relaxed criteria.

Within noise suppressor 230*a*, the speech plus noise signal s(t) from main beam forming unit 214*a* is transformed by a transformer 232*a* to provide a transformed speech plus noise signal S(ω). In an embodiment, the signal s(t) is transformed one block at a time, with each block including L data samples for the signal s(t), to provide a corresponding transformed block. Each transformed block of the signal S(ω) includes L elements, $S_n(\omega_0)$ through $S_n(\omega_{L-1})$, corresponding to L frequency bins, where n denotes the time instant associated with the transformed block. Similarly, the mostly noise signal x(t) from blocking beam forming unit 214*b* is transformed by a transformer 232*b* to provide a transformed mostly noise signal X(ω). Each transformed block of the signal X(ω) also includes L elements, $X_n(\omega_0)$ through $X_n(\omega_{L-1})$. In the specific embodiment shown in FIG. 2, transformers 232*a* and 232*b* are each implemented as a fast Fourier transform (FFT) that transforms a time-domain representation into a frequency-domain representation. Other type of transform may also be used, and this is within the scope of the invention. The size of the digitized data block for the signals s(t) and x(t) to be transformed can be selected based on a number of considerations (e.g., computational complexity). In an embodiment, blocks of 128 samples at the typical audio sampling rate are transformed, although other block sizes may also be used. In an embodiment, the samples in each block are multiplied by a Hanning window function, and there is a 64-sample overlap between each pair of consecutive blocks.

The magnitude component of the transformed signal S(ω) is provided to a multiplier 236 and a noise spectrum estimator 242. Multiplier 236 scales the magnitude component of S(ω) with a set of gain coefficients G(ω) provided by a gain calculation unit 244. The scaled magnitude component is then recombined with the phase component of S(ω) and provided to an inverse FFT (IFFT) 238, which transforms the recombined signal back to the time domain. The resultant output signal y(t) includes predominantly speech and has a large portion of the background noise removed.

It is sometime advantageous, though it may not be necessary, to filter the magnitude component of S(ω) and X(ω) so that a better estimation of the short-term spectrum magnitude of the respective signal can be obtained. One particular filter implementation is a first-order infinite impulse response (IIR) low-pass filter with different attack and release time.

Noise spectrum estimator 242 receives the magnitude of the transformed signal S(ω), the magnitude of the transformed signal X(ω), and the Act control signal from voice activity detector 240 indicative of periods of non-speech activity. Noise spectrum estimator 242 then derives the magnitude spectrum estimates for the noise N(ω), as follows:

$$|N(\omega)| = W(\omega)\cdot|X(\omega)|, \qquad \text{Eq (1)}$$

where W(ω) is referred to as the channel equalization coefficient. In an embodiment, this coefficient may be derived based on an exponential average of the ratio of magnitude of S(ω) to the magnitude of X(ω), as follows:

$$W_{n+1}(\omega) = \alpha W_n(\omega) + (1-\alpha)\frac{|S(\omega)|}{|X(\omega)|}, \qquad \text{Eq (2)}$$

where α is the time constant for the exponential averaging and is $0<\alpha\leqq 1$. In a specific implementation, α=1 when voice activity indicator 240 indicates a speech activity period and α=0.98 when voice activity indicator 240 indicates a non-speech activity period.

Noise spectrum estimator 242 provides the magnitude spectrum estimates for the noise N(ω) to gain calculator 334, which then uses these estimates to generate the gain coefficients G(ω) for multiplier 334.

With the magnitude spectrum of the noise |N(ω)| and the magnitude spectrum of the signal |S(ω)| available, a number of spectrum modification techniques may be used to determine the gain coefficients G(ω). Such spectrum modification techniques include a spectrum subtraction technique, Weiner filtering, and so on.

In an embodiment, the spectrum subtraction technique is used for noise suppression, and the gain coefficients G(ω) may be determined by first computing the SNR of the speech plus noise signal S(ω) and the mostly noise signal N(ω), as follows:

$$SNR(\omega) = \frac{|S(\omega)|}{|N(\omega)|}. \qquad \text{Eq (3)}$$

The gain coefficient G(ω) for each frequency bin ω may then be expressed as:

$$G(\omega) = \max\left(\frac{(SNR(\omega)-1)}{SNR(\omega)}, G_{\min}\right), \qquad \text{Eq (4)}$$

where $G_{min}$ is a lower bound on G(ω).

Gain calculator 244 thus generates a gain coefficient $G(\omega_j)$ for each frequency bin j of the transformed signal S(ω). The gain coefficients for all frequency bins are provided to multiplier 236 and used to scale the magnitude of the signal S(ω).

In an aspect, the spectrum subtraction is performed based on a noise N(ω) that is a time-varying noise spectrum derived from the mostly noise signal x(t), which may be provided by the blocking beam former. This is different from the spectrum subtraction used in conventional single microphone design whereby N(ω) typically comprises mostly stationary or constant values. This type of noise suppression is also described in U.S. Pat. No. 5,943,429, entitled "Spectral Subtraction Noise Suppression Method," issued Aug. 24, 1999, which is incorporated herein by reference. The use of a time-varying noise spectrum (which more accurately reflects the real noise in the environment) allows the inventive noise suppression techniques to cancel non-stationary noise as well as stationary noise (non-stationary noise cancellation typically cannot be achieve by conventional noise suppression techniques that use a static noise spectrum).

The spectrum subtraction technique for a single microphone is also described by S. F. Boll in a paper entitled "Suppression of Acoustic Noise in Speech Using Spectral Subtraction," IEEE Trans. Acoustic Speech Signal Proc., April 1979, vol. ASSP-27, pp. 113–121, which is incorporated herein by reference.

The spectrum modification technique is one technique for removing noise from the speech plus noise signal s(t). The spectrum modification technique provides good performance and can remove both stationary and non-stationary noise (using the time-varying noise spectrum estimate described above). However, other noise suppression techniques may also be used to remove noise, some of which are described below, and this is within the scope of the invention.

The noise suppression technique shown in FIGS. 2, 3A, and 3B provides good result even for wireless devices having small form factor. In general, it is desirable to maintain the size of the wireless devices to be as small as possible because of their portable nature. However, the small form factor also results in the microphones being located relatively close to each other (i.e., a small array). Conventional beam forming and noise suppression techniques generally cannot achieve good result for diffused noise source (i.e., not a direct noise source) based on a small array. In contrast, the noise suppression technique described herein can achieve good result even for a small array by employing the blocking beam former to derive the mostly noise signal x(t) on a second channel, and further using spectrum modification to cancel stationary and non-stationary noise.

Figure 4:
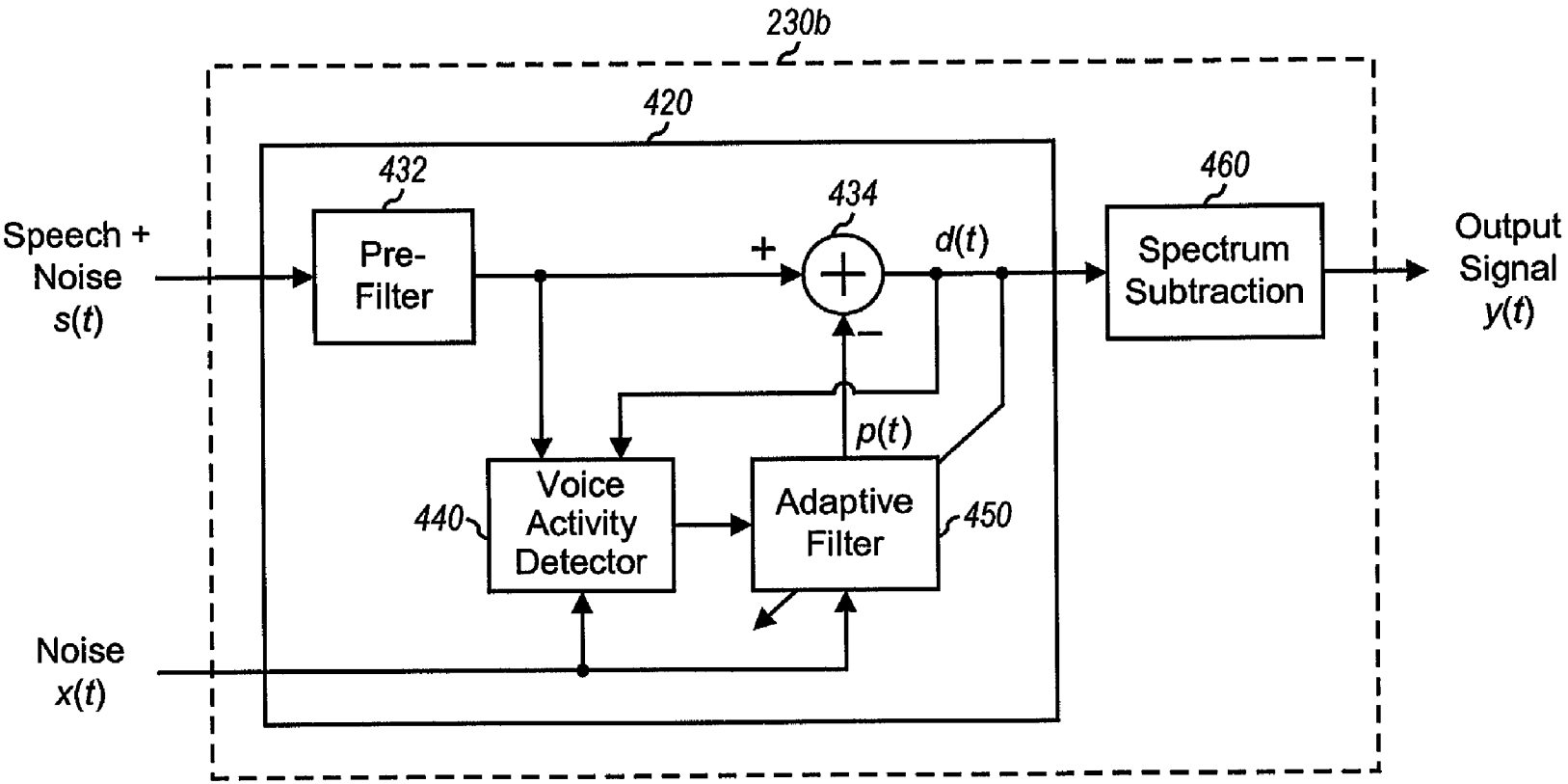
FIGS. 4, 5, and 6 are block diagrams of three different embodiments of the noise suppression unit.

FIG. 4 is a block diagram of a noise suppression unit 230*b* capable of removing background noise from a speech plus noise signal. Noise suppression unit 230*b* achieves the noise reduction/suppression in the time-domain.

Within noise suppression unit 230*b*, the speech plus noise signal s(t) is filtered by a pre-filter 432 to remove high frequency components, and the filtered speech plus noise signal is provided to a voice activity detector 440 and a summer 434. The mostly noise signal x(t) is provided to an adaptive filter 450, which filters the noise with a particular transfer function h(t). The filtered noise p(t) is then provided to summer 434 and subtracted from the filtered speech plus noise signal to provide an intermediate signal d(t) having predominantly speech and some amount of noise.

Adaptive filter 450 may be implemented with a "base" filter operating in conjunction with an adaptation algorithm (not shown in FIG. 4 for simplicity). The base filter may be implemented as a finite impulse response (FIR) filter, an infinite impulse response (IIR) filter, or some other filter type. The characteristics (i.e., the transfer function) of the base filter is determined by, and may be adjusted by manipulating, the coefficients of the filter. In an embodiment, the base filter is a linear filter, and the filtered noise h(t) is a linear function of the received noise x(t). In other embodiments, the base filter may implement a non-linear transfer function, and this is within the scope of the invention.

In an embodiment, the base filter is adapted during periods of non-speech activity. Voice activity detector 440 detects the presence of speech activity on the speech plus noise signal s(t) and provides a control signal that enables the adaptation of the coefficients of the base filter when no speech activity is detected. The adaptation algorithm can be implemented with any one of a number of algorithms such as the LMS, NLMS, RLS, DMI, and some other algorithms.

The base filter within adaptive filter 450 is adapted to implement (or approximate) the transfer function h(t), which describes the correlation between the noise components received on the signals s(t) and x(t). The base filter then filters the mostly noise signal x(t) with the transfer function h(t) to provide the filtered noise p(t), which is an estimate of the noise in the signal s(t). The estimated noise p(t) is then subtracted from the speech plus noise signal s(t) by summer 434 to generate the intermediate signal d(t). During periods of non-speech activity, the signal s(t) includes predominantly noise, and the intermediate signal d(t) represents the error between the noise received on the signal s(t) and the estimated noise p(t). The error signal d(t) is then provided to the adaptation algorithm within adaptive filter 450, which then adjusts the transfer function h(t) of the base filter to minimize the error.

In an embodiment, a spectrum subtraction unit 460 is used to further suppress noise components in the intermediate signal d(t) to provide the output signal y(t) having predominantly speech and a larger portion (or most) of the noise removed. Spectrum subtraction unit 460 can be implemented as described above for noise suppression unit 230*a*.

Figure 5:
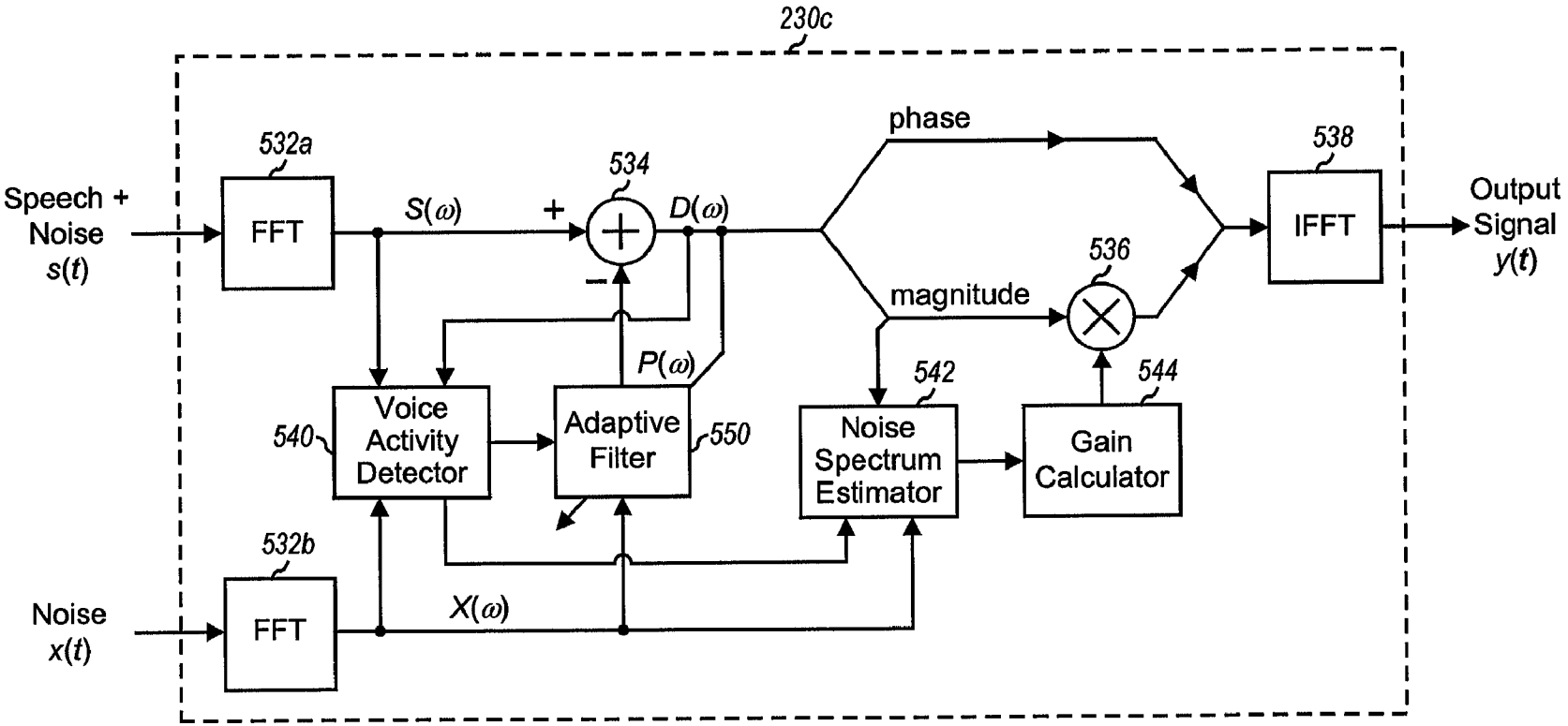

FIG. 5 is a block diagram of a noise suppression unit 230*c*, which is also capable of removing background noise from a speech plus noise signal. Noise suppression unit 230*c* achieves the noise reduction in the frequency-domain.

Within noise suppression unit 230*c*, the speech plus noise signal s(t) is transformed by a fast Fourier transformer (FFT) 532*a*, and the mostly noise signal x(t) is similarly transformed by a FFT 532*b*. Various other types of signal transform may also be used, and this is within the scope of the invention.

The transformed speech plus noise signal S(ω) is provided to a voice activity detector 540 and a summer 534. The transformed noise signal X(ω) is provided to an adaptive filter 550, which filters the noise with a particular transfer function H(ω). The filtered noise P(ω) is then provided to summer 534 and subtracted from the transformed speech plus noise S(ω) to provide an intermediate signal D(ω) that includes the speech component and has much of the low frequency noise component removed.

Adaptive filter 550 includes a base filter operating in conjunction with an adaptation algorithm. The base filter is adapted during periods of non-speech activity, as indicated by a control signal from voice activity detector 540. The adaptation may be achieved, for example, via an LMS algorithm. The base filter then filters the transformed noise X(ω) with the transfer function H(ω) to provide an estimate of the noise on the signal S(ω).

The noise components received on the signals S(ω) and X(ω) may be correlated. The degree of correlation determines the theoretical upper bound on how much noise can be cancelled using linear adaptive filter such as in block 420 and 550. A coherent function C(ω), which is indicative of the amount of statistical correlation between the two noise components, may be expressed as:

$$C(\omega) = \frac{E\{X(\omega)\cdot S^*(\omega)\}}{E\{|X(\omega)|\}\cdot E\{|S(\omega)|\}}, \quad \text{Eq (5)}$$

where X(ω) is the noise received on the signal x(t), S(ω) is representative of the noise received on the signal s(t), and E is the expectation operation. C(ω) is equal to zero (0.0) if $X(\omega)$ and $S(\omega)$ are totally uncorrelated, and is equal to one (1.0) if $X(\omega)$ and $S(\omega)$ are totally correlated. In the designs described above, the linear adaptive filter (such as the ones in blocks 420 and 550) can cancel the correlated noise components while the spectrum modification technique further suppresses un-correlated portion of the noise.

The magnitude component of the intermediate signal $D(\omega)$ is then provided to a noise spectrum estimator 542 and a multiplier 536. The operation of blocks 542 and 544 is similar to that of blocks 242 and 244, respectively, which have been described above.

Figure 6:
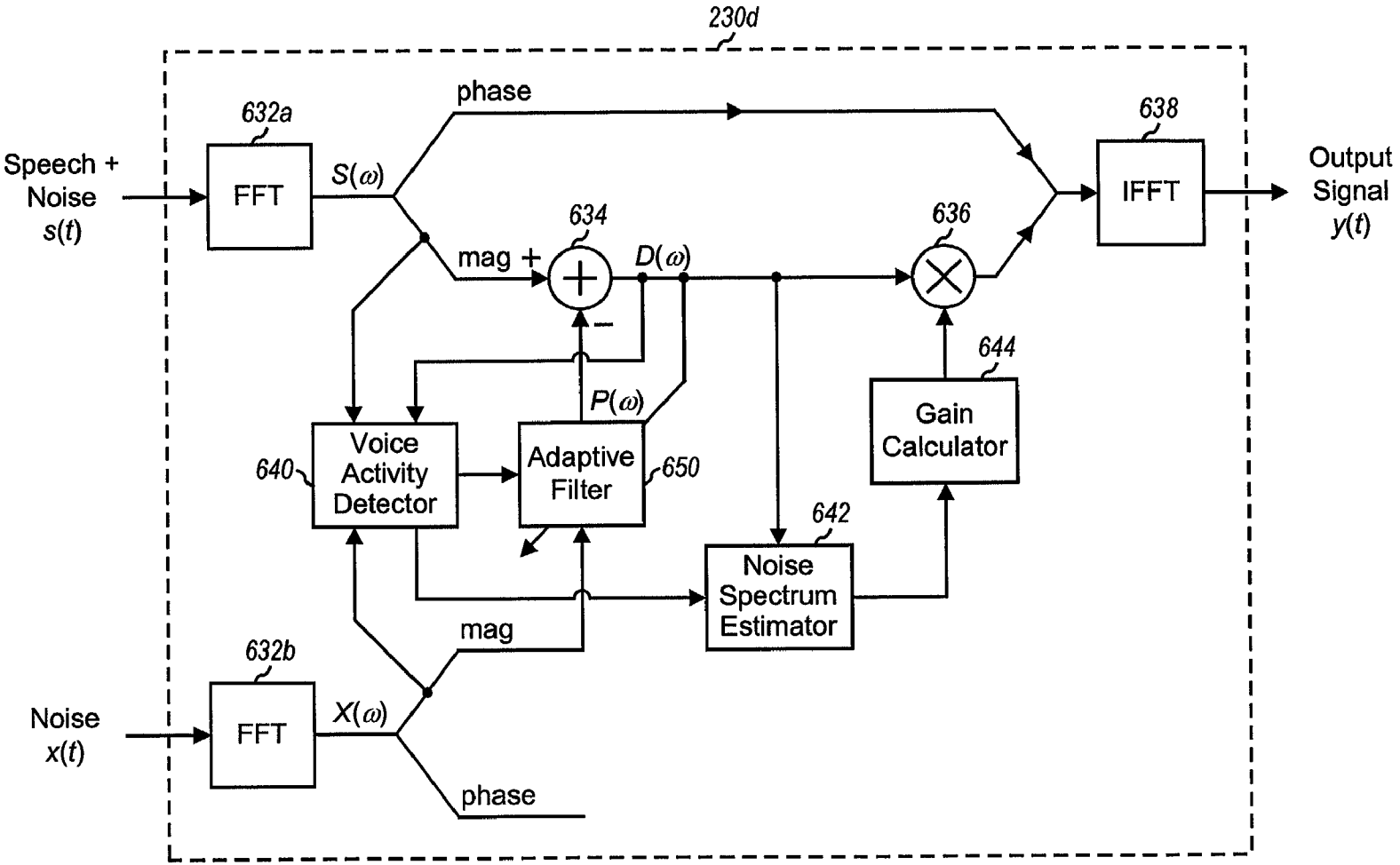

FIG. 6 is a block diagram of a noise suppression unit 230*d* that is also capable of removing background noise from a speech plus noise signal. Noise suppression unit 230*d* also achieves the noise reduction in the frequency domain, and may be used even if the noise components received by the two signals s(t) and x(t) are related by a non-linear function. In particular, noise suppression unit 230*d* is capable of removing deterministic noise component from the speech plus noise signal s(t).

Within noise suppression unit 230*d*, the speech plus noise signal s(t) is transformed (e.g., to the frequency domain) by an FFT 632*a*, and the mostly noise signal x(t) is similarly transformed by an FFT 632*b*. The magnitude component of the transformed speech plus noise signal $S(\omega)$ is provided to a voice activity detector 640 and a summer 634. The magnitude component of the transformed noise signal $X(\omega)$ is provided to an adaptive filter 650, which filters the noise with a particular transfer function $H(\omega)$. The filtered noise $P(\omega)$ is then provided to summer 634 and subtracted from the magnitude component of the transformed speech plus noise $S(\omega)$ to provide the magnitude component for an intermediate signal $D(\omega)$ having predominantly speech and a large portion of the low frequency noise removed.

Adaptive filter 650 includes a base filter operating in conjunction with an adaptation algorithm. The base filter is adapted during periods of non-speech activity, as indicated by a control signal from voice activity detector 640. Again, the adaptation may be achieved via an LMS algorithm or some other algorithm. The base filter then filters the transformed noise with the transfer function $H(\omega)$ to provide an estimate of the noise received on the signal $S(\omega)$.

The transfer function of the base filter may be a linear or non-linear function. A linear transfer function may be implemented similar to that described above for FIG. 5. In an embodiment, a non-linear transfer function may be implemented as follows:

$$\underline{P}=\underline{H}\underline{X}, \qquad \text{Eq (6)}$$

where $\underline{P}$ is a vector of L transformed elements for the estimated noise (i.e., $P_n(\omega_0)$ through $P_n(\omega_{L-1})$, $\underline{X}$ is a vector of L transformed elements for the mostly noise signal x(t) (i.e., $X_n(\omega_0)$ through $X_n(\omega_{L-1})$, and $\underline{H}$ is a matrix of the transfer function for the base filter. Each estimated element, $P_n(\omega_j)$, at time n for frequency bin j can be expressed as:

$$\begin{aligned} P_n(\omega_j) &= \sum_{i=0}^{L-1} H_n(i, j)\cdot X_n(\omega_i) \\ &= H_n(0, j)\cdot X_n(\omega_0) + H_n(1, j)\cdot X_n(\omega_1) + \ldots + \\ &\quad H_n(L-1, j)\cdot X_n(\omega_{L-1}) \end{aligned}$$

where j=0, 1, . . . L-1. Thus, for this specific transfer function, each estimated element $P_n(\omega_j)$ is a linear combination of the L elements of the noise $X_n(\omega)$ weighted by $H_n(\omega)$.

Other non-linear transfer functions may also be used and are within the scope of the invention.

In the embodiment shown in FIG. 6, additional signal processing is performed on the intermediate signal $D(\omega)$ to remove higher frequency noise component. The magnitude component of the intermediate signal $D(\omega)$ is provided to a noise spectrum estimator 642 and a multiplier 636. Noise spectrum estimator 642 also receives the control signal from voice activity detector 640 indicative of periods of speech and non-speech activity, and estimates the spectrum or power spectral density (PSD) of each of the speech and noise components based on the magnitude of the signal $D(\omega)$. The PSD estimates for the speech and noise are provided to a gain calculation unit 644. Again, the speech and noise PSD estimates can be performed as described above and in the aforementioned U.S. Pat. No. 5,943,429.

Gain calculation unit 644 generates a scaling factor for each frequency bin of the intermediate signal $D(\omega)$. The scaling factors for all frequency bins can be generated in the manner described above and in the aforementioned U.S. Pat. No. 5,943,429. The scaling factors are then provided to multiplier 636 and used to scale the magnitude of the intermediate signal $D(\omega)$. The scaled magnitude component is recombined with the phase component and provided to an inverse FFT (IFFT) 638, which transforms the recombined signal back to the time domain. The resultant output signal y(t) from IFFT 638 includes predominantly speech and has a larger portion of the noise removed. Again, most of the deterministic noise component can be removed by noise suppression unit 230*d*.

Other signal processing schemes maybe used to process the speech plus noise signal s(t) and the mostly noise signal x(t) to provide the desired output signal y(t) having mostly speech and a large portion of the noise removed. These various signal processing schemes are also within the scope of the invention.

If beam forming units are used as shown in FIG. 2, then various types of microphones can be supported. The processing to derive the speech plus noise signal s(t) and the mostly noise signal x(t) may be performed by the main and blocking beam formers, respectively, as described above in FIG. 2. However, the signals s(t) and x(t) may also be derived without the use of the beam formers, as described below.

Figure 7A:
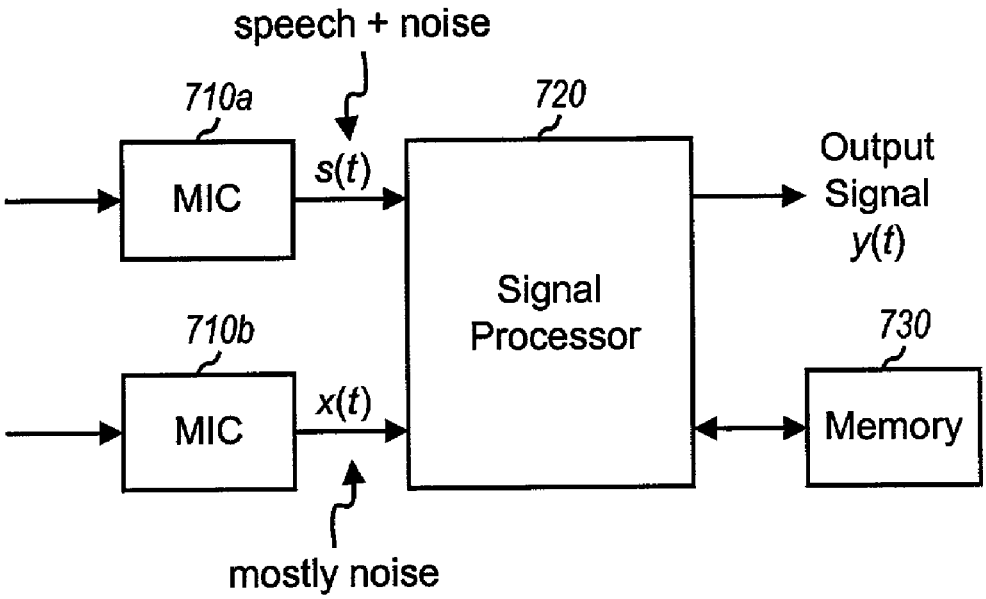
FIGS. 7A and 7B are diagrams of another speech processing system suitable for removing background noise from a speech plus noise signal.

FIG. 7A is a block diagram of a speech processing system 700 suitable for removing background noise from a speech plus noise signal, and may also be used for both near-field and far-field applications. Within system 700, speech plus noise is received via a first microphone 710*a*, and mostly noise is received via a second microphone 710*b*. Microphone 710*a* thus receives the desired speech from a speaking user and the undesired background noise from the environment. Microphone 710*b* is configured to detect mostly the noise component to be suppressed from the signal received by microphone 710*a*.

Figure 7B:
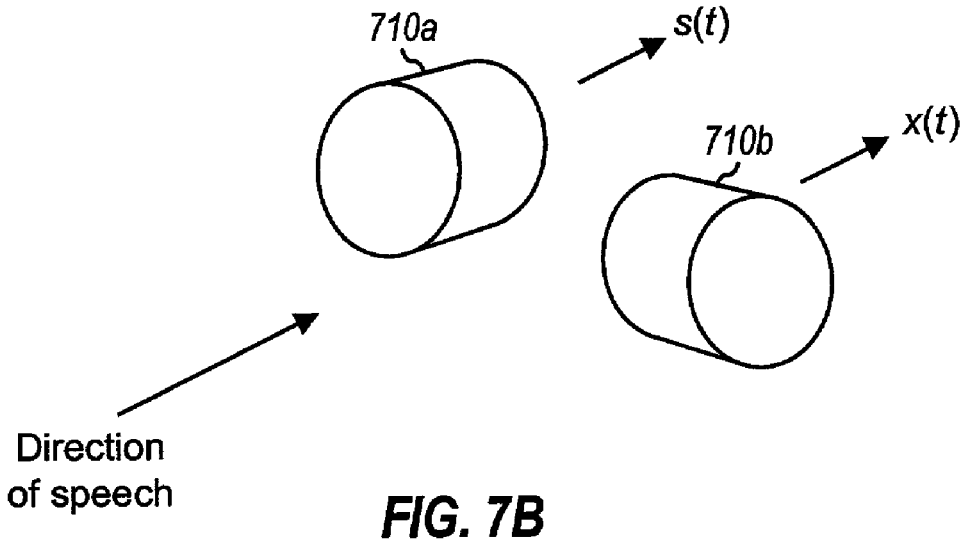

FIG. 7B is a diagram that illustrates a simple configuration of two dipole microphones used to derive the signals s(t) and x(t). The ability to pick up signal plus noise or mostly noise may be achieved by proper placement of the microphones and/or use of certain types of microphones. For example, microphone 710*a* may be located on the device such that it is close to the mouth during use (e.g., microphone 110*b* in FIG. 1B), in which case the speech component is typically larger than the noise component. Conversely, microphone 710*b* may be located such that the noise component is larger than the speech component.

Microphones 710*a* and 710*b* may also be implemented with dipole microphones (or pressure gradient microphones). A dipole microphone has two main "lobes" and can pick up signal from both the front and back but not the side (its nulls). If the direction of speech is known or fixed, then microphone 710*a* may be placed on the device such that its main lobe points toward the direction of the speech so that mostly speech is picked up by the microphone, as shown in FIG. 7B. Conversely, microphone 710*b* may be placed such that its null points toward the direction of speech so that little speech is picked up by the microphone, as also shown in FIG. 7B.

Referring back to FIG. 7A, microphone 710*a* provides the signal s(t) comprised of the signal plus noise, and microphone 710*b* provides the signal x(t) comprised of mostly the noise component. For this microphone configuration, the main and blocking beam forming units are not needed to generate s(t) and x(t), respectively.

The speech and noise signal s(t) from microphone 710*a* and the mostly noise signal x(t) from microphone 710*b* are provided to a signal processing unit 720, which processes the signals s(t) and x(t) to provide an output signal y(t) that includes mostly speech. Signal processing unit 720 may be designed to implement noise suppression unit 230*a*, 230*b*, 230*c*, or 230*d*, or some other noise suppressor design. A memory 730 may be used to provide storage for data and/or program codes used by signal processor 720.

As noted above, any number of microphones (i.e., greater than one) may be used (in combination with noise suppression) to generate the desired output signal. The embodiments shown in FIGS. 1A through 1C are illustrative, and greater or fewer number of microphones may be used.

Digital signal processing is used herein to process the signals from the microphones to generate the desired output signal. The use of digital signal processing allows for the easy implementation of (1) various algorithms (e.g., the NLMS algorithm) used for the signal processing, (2) the processing of the signals in the frequency-domain, which may provide improved performance, (3) and other advantages.

The signal processing described herein (especially the embodiment FIG. 2) may be used to provide the desired output signal for both near-field and far-field applications. For far-field applications, adaptive beam forming may be used to obtain the speech plus noise signal s(t) and the mostly noise signal x(t). Beam forming may also be used for near-field application. For certain microphone configurations (such as that shown in FIG. 7A), the signals from the microphones may be used directly for the speech plus noise signal s(t) and the mostly noise signal x(t). In either case, the same signal processing may be used to process the signals s(t) and x(t), however derived, to adaptively determine the noise component, and to suppress this noise component from the speech plus noise signal to provide the desired output signal. The ability to support both near-field and far-field applications is especially advantageous for wireless communication devices.

The noise suppression described herein provides an output signal having improved characteristics. A large portion of the noise may be removed from the signal, which improves the quality of the output signal. The techniques described herein allows a user to talk softly even in a noisy environment, which provides privacy and is highly desirable.

The noise suppression techniques described herein may be implemented within a small form factor. The microphones may be placed closed to each other (e.g., only five centimeters of separation between microphones may be sufficient). Also the microphones are not placed in an end-fire type of configuration, i.e., one in which the microphones are placed in front of one another along an axis that is pointed approximately toward the sound source. This small form factor allows the noise suppression to be implemented in various types of device such as cellular telephones, personal digital assistance (PDAs), tape recorders, telephones, and so on.

For simplicity, the signal processing systems described above use microphones as signal detectors. Other types of signal detectors may also be used to detect the desired and undesired components. For certain applications, sensors may be used to detect other types of noise such as vibration, road noise, motion, and others.

For clarity, the signal processing systems have been described for the processing of speech. In general, these systems may be used process any signal having a desired component and an undesired component.

The signal processing systems and techniques described herein maybe implemented in various manners. For example, these systems and techniques may be implemented in hardware, software, or a combination thereof. For a hardware implementation the signal processing elements (e.g., the beam forming units, noise suppression, and so on) may be implemented within one or more application specific integrated circuits (ASICs), digital signal processors (DSPs), programmable logic devices (PLDs), controllers, microcontrollers, microprocessors, other electronic units designed to perform the functions described herein, or a combination thereof. For a software implementation, the signal processing systems and techniques may be implemented with modules (e.g., procedures, functions, and so on) that perform the functions described herein. The software codes may be stored in a memory unit (e.g., memory 730 in FIG. 7) and executed by a processor (e.g., signal processor 720). The memory unit may be implemented within the processor or external to the processor, in which case it can be communicatively coupled to the processor via various means as is known in the art.

The foregoing description of the specific embodiments is provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein, and as defined by the following claims.

What is claimed is:

1. A mobile communication device comprising:

a plurality of signal detectors mounted on the mobile communication device, the plurality of signal detectors being placed in close proximity to one another and forming a small array, each signal detector configured to provide a respective detected signal having a desired component plus an undesired component;

a first beam forming unit operatively coupled to the plurality of signal detectors and configured to process the plurality of detected signals to generate a first signal having the desired component plus a portion of the undesired component;

a second beam forming unit operatively coupled to the plurality of signal detectors and configured to process the plurality of detected signals to generate a second signal having mostly the undesired component;

an activity detector configured to receive the first and second signals, to detect for speech activity based on the first and second signals, and to provide a control signal indicative of detected speech activity;

a controller operatively coupled to the first and second forming units and the activity detector and configured to receive the control signal, to enable the first beam forming unit to adapt during periods of speech activity, and to enable the second beam forming unit to adapt during periods of non-speech activity; and a noise suppression unit operatively coupled to the first and second beam forming units and configured to receive and digitally process the first and second signals to obtain an output signal having substantially the desired component and a large portion of the undesired component removed.

2. The device of claim 1, wherein the first beam forming unit comprises a first set of at least one adaptive filter, each adaptive filter in the first set configured to filter a respective detected signal to minimize an error between an output of the adaptive filter and a designated detected signal during the periods in which the first beam forming unit is enabled, and wherein the second beam forming unit comprises a second set of at least one adaptive filter, each adaptive filter in the second set configured to filter a respective detected signal to minimize an error between an output of the adaptive filter and the second signal during the periods in which the second beam forming unit is enabled.

3. The device of claim 1, wherein the first and second beam forming units and the noise suppression unit are implemented within a digital signal processor (DSP).

4. The device of claim 1, wherein the signal detectors are microphones.

5. The device of claim 4 and comprising two microphones.

6. The device of claim 1, wherein the noise suppression unit is operative to remove the undesired component in the first signal using spectrum modification.

7. The device of claim 1, wherein the noise suppression unit digitally processes the first and second signals in the frequency domain.

8. The device of claim 7, wherein the noise suppression unit includes a first transformer coupled to the first beam forming unit and configured to receive and transform the first signal into a first transformed signal, and a second transformer coupled to the second beam forming unit and configured to receive and transform the second signal into a second transformed signal.

9. The device of claim 8, wherein the noise suppression unit further includes a multiplier configured to receive and scale the first transformed signal with a set of coefficients.

10. The device of claim 9, wherein the set of coefficients are derived based on spectrum subtraction.

11. The device of claim 9, wherein the noise suppression unit further includes a noise spectrum estimator operative to receive and process the second transformed signal to provide a noise spectrum estimate, and a gain calculation unit operative to receive the first transformed signal and the noise spectrum estimate and provides the set of coefficients for the multiplier.

12. The device of claim 11, wherein the noise spectrum estimator is operative to provide a time-varying noise spectrum estimate.

13. The device of claim 1, wherein the noise suppression unit comprises an adaptive filter operative to receive and process the first and second signals and to provide a filtered signal having correlated noise removed.

14. The device of claim 8, wherein the noise suppression unit comprises an adaptive filter operative to receive and process the first and second transformed signals in the frequency domain and to provide a filtered signal having correlated noise removed.

15. The device of claim 1 and operative to receive and process far-field signals.

16. The device of claim 1 and operative to receive and process near-field signals.

17. The device of claim 1, wherein each of the first and second beam forming units includes at least one adaptive filter, each adaptive filter operative to receive and process a signal from a respective signal detector to provide a corresponding filtered signal.

18. The device of claim 17, wherein each adaptive filter implements a least mean square (LMS) algorithm.

19. The device of claim 1, wherein the device is a cellular phone.

20. A wireless communication device comprising:

at least two microphones mounted on the wireless communication device, the at least two microphones being placed in close proximity to one another and forming a small array, each microphone configured to detect and provide a respective signal having a desired component plus an undesired component; and a signal processor coupled to the at least two microphones and configured to receive and digitally process the detected signals from the microphones with a first beam forming unit to obtain a first signal having the desired component plus a portion of the undesired component, to process the detected signals with a second beam forming unit to obtain a second signal having mostly the undesired component, to detect for speech activity based on the first and second signals, to determine periods of speech activity and periods of non-speech activity based on the detected speech activity, to enable the first beam forming unit to adapt during the periods of speech activity, to enable the second beam forming unit to adapt during the periods of non-speech activity, and to process the first and second signals to obtain an output signal having substantially the desired component and a large portion of the undesired component removed.

21. The device of claim 20, wherein the signal processor digitally processes the detected signals in the frequency domain.

22. The device of claim 20, wherein the signal processor digitally processes the detected signals in the time domain.

23. The device of claim 20, wherein the signal processor is operative to remove the undesired component from the output signal using spectrum subtraction.

24. The device of claim 20, wherein the first beam forming unit comprises a first set of at least one adaptive filter, each adaptive filter in the first set configured to filter a respective detected signal to minimize an error between an output of the adaptive filter and a designated detected signal during the periods in which the first beam forming unit is enabled, and wherein the second beam forming unit comprises a second set of at least one adaptive filter, each adaptive filter in the second set configured to filter a respective detected signal to minimize an error between an output of the adaptive filter and the second signal during the periods in which the second beam forming unit is enabled.

25. The device of claim 20, wherein the signal processor is operative to process far-field signals or near-field signals.

26. The device of claim 20, wherein the microphones are placed close to each other relative to a wave-length of sound and not in an end-fire type of configuration.

27. An apparatus comprising:

means for detecting at least two signals via at least two signal detectors mounted on the apparatus, the at least two signal detectors being placed in close proximity to one another and forming a small array, wherein each detected signal includes a desired component plus an undesired component;

means for processing the detected signals with a first beam forming unit to obtain a first signal having substantially the desired component plus a portion of the undesired component;

means for processing the detected signals with a second beam forming unit to obtain a second signal having mostly the undesired component;

means for detecting for speech activity based on the first and second signals and providing a control signal indicative of detected speech activity;

means for enabling the first beam forming unit to adapt during periods of speech activity;

means for enabling the second beam forming unit to adapt during periods of non-speech activity; and means for digitally processing the first and second signals to obtain an output signal having substantially the desired component and a large portion of the undesired component removed.

28. The apparatus of claim 27, wherein the means for digitally processing the first and second signals includes means for removing the undesired component from the output signal using spectrum subtraction.

29. The apparatus of claim 28, wherein the means for digitally processing the first and second signals further includes means for estimating a noise spectrum of the undesired component based on the second signal, means for deriving a set of coefficients based on spectrum subtraction, and means for scaling transformed representation of the first signal based on the set of coefficients.

30. The apparatus of claim 29, wherein the means for digitally processing the first and second signals includes means for providing a time-varying noise spectrum estimate.

* * * * *